US006003240A

United States Patent [19]

Akimoto et al.

[11] Patent Number: 6,003,240

[45] **Date of Patent: *Dec. 21, 1999**

[54] VESSEL DRIER HAVING HIGH HEAT EFFICIENCY

[75] Inventors: Shigeru Akimoto, Shiga-ken; Hiroshi Morii, Kyoto; Kenji Ueno, Shiga-ken; Masahiko Takami, Ohmihachiman, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/826,156

[22] Filed: Mar. 27, 1997

[30] Foreign Application Priority Data

Apr. 1, 1996 [JP] Japan ..... 8-078665

[51] Int. Cl.[6] ..... F26B 25/00

[52] U.S. Cl. ..... 34/104; 34/105; 241/65; 241/171

[58] Field of Search ..... 34/104, 105, 595, 34/602, 603; 165/89, 90, 92, 181, 182, 183, 184; 432/108

[56] References Cited

U.S. PATENT DOCUMENTS

| | | | |
|---|---|---|---|
| 3,559,823 | 2/1971 | Ostrin | 214/23 |
| 4,014,106 | 3/1977 | Bearce | 34/142 |
| 4,060,042 | 11/1977 | Baraldi et al. | 110/14 |
| 4,393,603 | 7/1983 | Casperson | 34/39 |
| 5,309,982 | 5/1994 | Aliano | 165/76 |
| 5,529,251 | 6/1996 | Takami et al. | 241/65 |
| 5,655,313 | 8/1997 | Hope et al. | 34/323 |

FOREIGN PATENT DOCUMENTS 7-100403 4/1995 Japan .

*Primary Examiner*—Henry Bennett
*Assistant Examiner*—Pamela A. Wilson
*Attorney, Agent, or Firm*—Ostrolenk, Faber, Gerb & Soffen, LLP

[57] ABSTRACT

A vessel drier for producing a powder material, includes a cylindrical container, a heating source, and a plurality of heat conductive members. The cylindrical container has an inner space to contain a fluid raw material and is adapted to rotate along a rotation axis thereof. The heating source is provided outside the cylindrical container to heat the cylindrical container. The heat conductive members are provided at an outer surface of the cylindrical container so as to enlarge the area of the outer surface of the cylindrical container.

20 Claims, 5 Drawing Sheets

FIG. 6
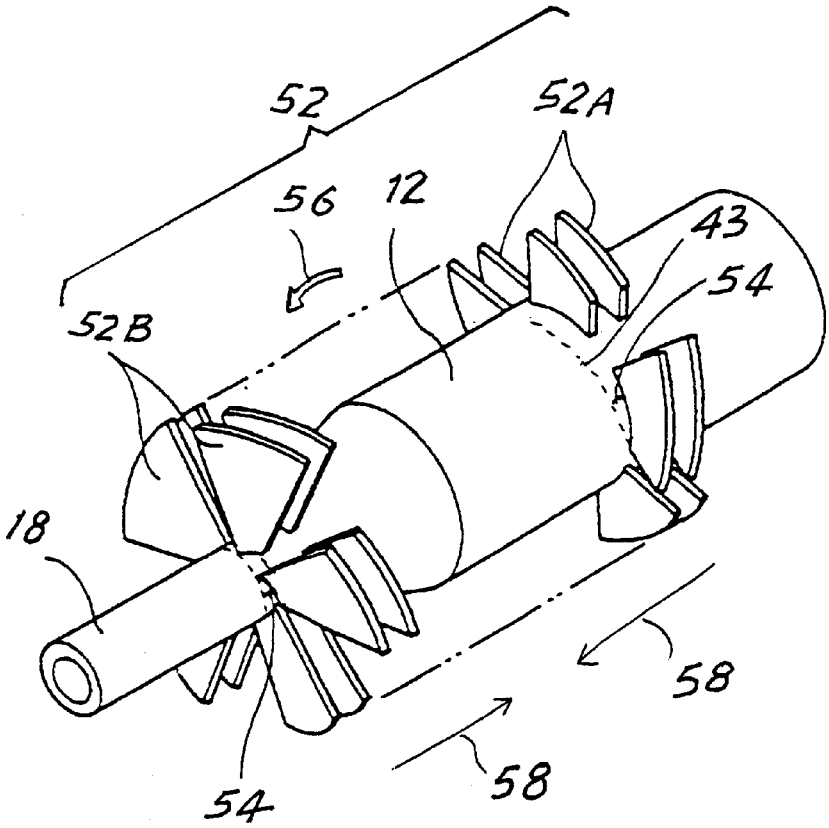
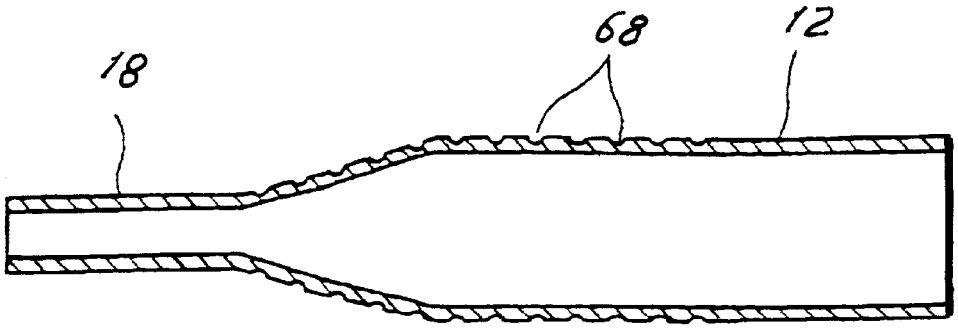
FIG. 8

VESSEL DRIER HAVING HIGH HEAT EFFICIENCY

BACKGROUND OF THE INVENTION

1. Field of the Invention

The present invention relates to a vessel drier which heat treats a fluid having a solid material suspended therein to form a powdery material.

2. Description of the Related Art

Powdered materials may be manufactured by heat treating (e.g., drying or pre-sintering) a fluid containing a solid material therein. By way of example, a fluid suspension containing a ceramic component (i.e., a ceramic slurry of a ceramic component and fluid) may be subjected to a heat treatment process using, for example, a vessel drier.

A conventional vessel has three main components: a cylindrical container, a plurality of ceramic balls located in the container and a heater which provides heat to the container.

The heater is provided outside the cylindrical container and heats both the cylindrical container and the ceramic balls located therein. The walls and the ceramic balls apply heat to the ceramic slurry located in the cylindrical container thereby causing vaporization of the fluid from the ceramic slurry. As a result of this vaporization process, a residue of the ceramic component will be formed on the surfaces of the balls and on the walls of the cylindrical container.

The container is driven for rotation about its central axis so as to cause the ceramic balls to continually rub against one another and act much like a mortar and pestle to crush the residue of ceramic material formed on the balls. This yields a powdered ceramic material which is evacuated though an outlet connected to the cylindrical container.

The convention vessel drier has several drawbacks relating to the efficiency at which heat is applied to the cylindrical container. The ceramic powder forming process is a continuous process. New slurry is continually (or at least periodically) added to the container and the resultant powdered ceramic material is continually (or at least periodically) removed from the container. If the amount of the ceramic slurry supplied to the cylindrical container is too great, insufficient heat will be supplied to the ceramic slurry and efficient processing will not take place. The amount of ceramic slurry which can be processed through the vessel dryer is a direct function of the heat transfer between the cylindrical container and a heater. Because the heat transfer between the cylindrical container and a heater of a conventional vessel drier is relatively low, it is not possible to increase the throughput of the heating process to desired levels.

One possible solution to this problem is to provide a larger heater. However, this is not an efficient solution to the problem because the enthalpy per a unit area (the total amount of heat per unit area) which the cylindrical container receives does not increase proportionally to the increase in the size of the heater. Alternatively, a larger heater may be employed and the diameter of the cylindrical container may be increased. However, this results in an undesirable increase in the size of the vessel drier. The effective production yield of the process can also be increased by utilizing a more powerful heater. However, this makes it necessary to provide a vessel drier which uses more refractory material to withstand the additional heat output of the heater.

In view of the forgoing, there is a need to provide a vessel drier which will maintain a high production yield even though the amount of a raw material per a unit time treated by the vessel drier increases.

SUMMARY OF THE INVENTION

The present invention is directed to a vessel drier that satisfies this need. The vessel drier for producing a powdered material, includes a cylindrical container, a heating source, and a plurality of heat conductive members thermally coupled to the cylindrical container. The cylindrical container has an inner space adapted to contain a fluid raw material and is rotated along a rotation axis thereof. The heating source is provided outside the cylindrical container to heat the cylindrical container. The heat conductive members are provided at an outer surface of the cylindrical container and preferably have a ring plate, stick, or fin shape.

According to the aforementioned construction, the heat conductive members enlarge the effective surface area of the outer surface of the cylindrical container, while the area of the inner surface of the cylindrical container is not changed. Thus, the heat generated at the heat source can be efficiently received by the cylindrical container, and the heat capacity of the cylindrical container increases, thereby maintaining the high production yield even though an amount of a raw material per a unit time to be treated by the drier increases.

BRIEF DESCRIPTION OF THE DRAWINGS

For the purpose of illustrating the invention, there is shown in the drawing several forms which are presently preferred, it being understood, however, that the invention is not limited to the precise arrangements and instrumentalities shown.

FIG. 6 shows a perspective view of a main portion of a vessel drier according to a fifth embodiment of the present invention.

FIG. 8 shows a cross-sectional view of main portion of a vessel drier according to a seventh embodiment of the present invention.

DETAILED DESCRIPTION OF PREFERRED EMBODIMENTS

Figure 1:
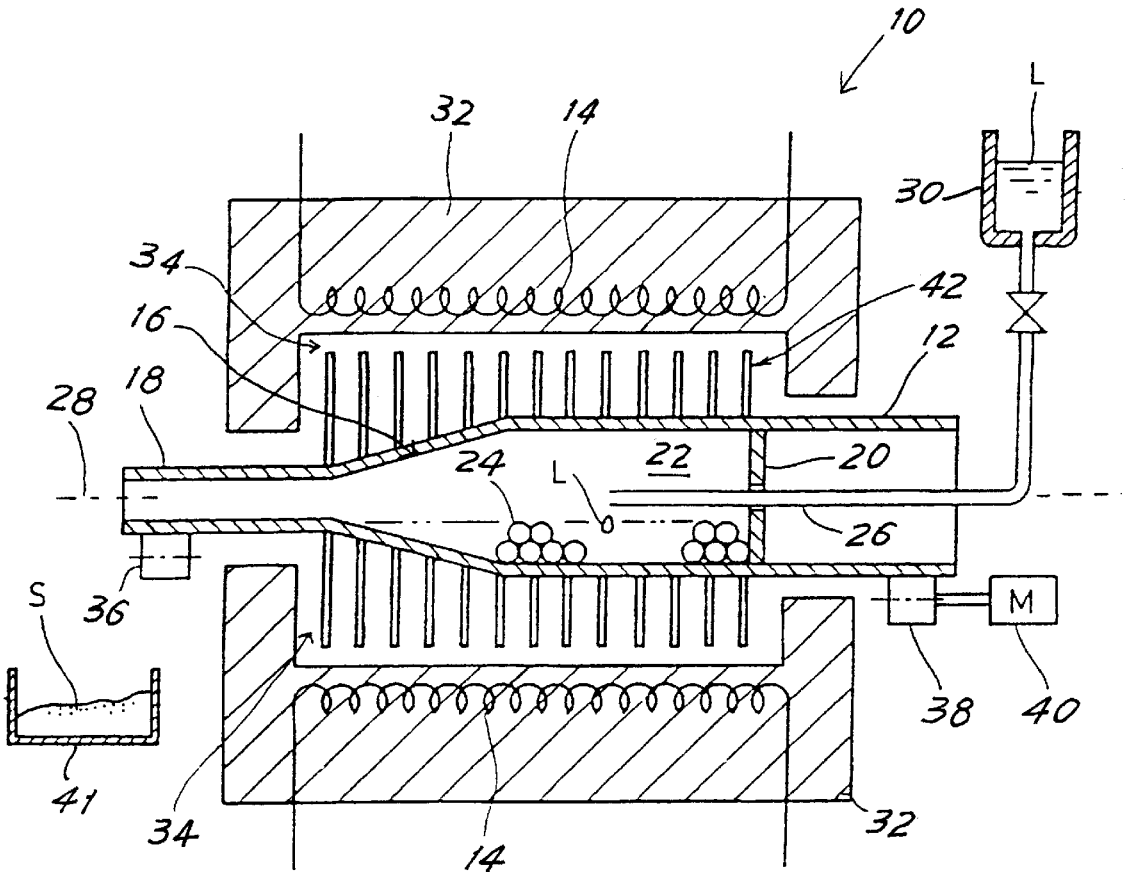
FIG. 1 shows a cross sectional view of a vessel drier according to a first embodiment of the present invention.
Figure 2:
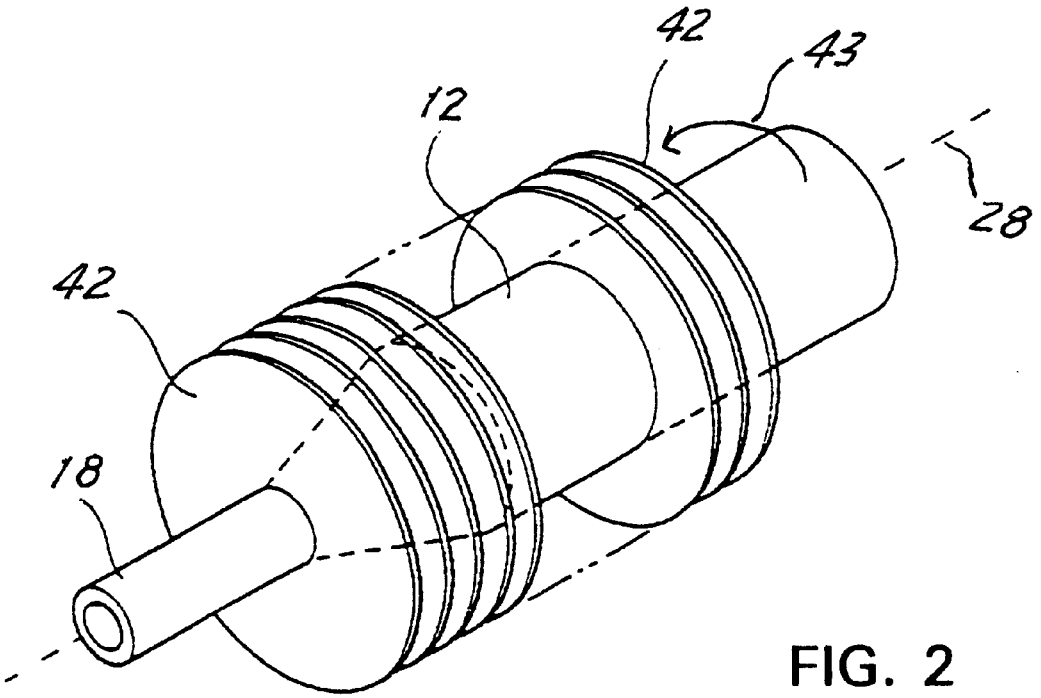
FIG. 2 shows a perspective view of the main portion of the vessel drier shown in FIG. 1.

Referring now to the drawings wherein like numerals indicate like elements, there is shown in FIGS. 1 and 2 a first preferred embodiment of a vessel drier constructed in accordance with the principles of the present invention and designated generally as 10. The vessel drier 10 is preferably used to heat treat a ceramic slurry to form a powdered ceramic material, typically having a particle diameter about 0.1 to 10 $\mu$m.

Vessel drier 10 includes a cylindrical container 12 and a heat source 14 provided along the outside of the cylindrical container 12. A processing space 22 is defined inside the container 12 between a partition 20 and the tapered end 16 of the container. A plurality of tumbling members 24 (preferably balls made of ceramic material or the like) are located in the processing space 22 to heat the ceramic slurry L introduced into the processing space 22 and to pulverize the ceramic residue which forms on the tumbling members 24 during the heat treatment process.

The narrow end of the tapered portion 16 is connected to a tubular outlet 18 which is preferably aligned with a rotation axis 28 of cylindrical container 12. In this embodiment of the invention, the ceramic slurry L is introduced into the processing space 22 via a tubular inlet 26 which penetrates the partition wall 20 and is aligned with the rotation axis 28 of the container 12. The slurry L is supplied from a slurry reservoir 30 through tubular inlet 26 and is introduced into the processing space 22 at a location in the vicinity of the center of the processing space 22.

A furnace 32 is provided outside the cylindrical container 12 and defines a heating space 34 located between the outer surface of the cylindrical container 12 and the inner surface of the furnace 32. The heat source 14 is preferably mounted at the inner surface of the furnace 32. While an electric heater is shown, other types of heaters, such as a gas heater or high frequency induction heater, may be used.

Both the tubular outlet 18 and the untapered portion of the container 12 preferably extend outside of the furnace 32 and are supported for rotation about the central axis of the container 12 by rollers 36 and 38 such that the rotation axis 28 is generally horizontal. A motor 40, which may be connected to the roller 38, causes rotation of the cylindrical container 12.

The vessel drier 10 further includes a plurality of heat conductive members 42 which are thermally coupled to the cylindrical container and adapted to conduct heat located in the heating space 34 into processing space 22 of the cylindrical container 12. In the illustrated embodiment, the heat conductive members 42 are provided on the outer surface of the cylindrical container 12.

As is best shown in FIG. 2, each of the heat conductive members 42 takes the form of a flat, ring shaped plate formed entirely along a circumferential direction 43 of the cylindrical container 12. As best shown in FIG. 1, it is preferable to arrange an plurality of the heat conductive members 42 at spaced locations along the axis of the cylindrical container 12 so that the heat conductive members 42 are disbursed throughout the heating space 34. The cylindrical container 12 and the conductive members 42 are preferably made of a material having a refractory property. By way of example, a nickel alloy can be used.

Since the heat conductive members 42 are connected to the outer surface of the cylindrical container 12, the effective area of the outer surface of the cylindrical container 12 is greatly increased without changing the area of the inner surface of the cylindrical container 12. This ensures a more efficient transfer of heat from the heater 14 to the processing space 22 of the container 12. This result is achieved because heat is transferred from the heating space 34 to the processing space 22 both via the outer surface of the cylindrical container 12 and the heat conductive members 42. Moreover, since the heat conductive members 42 rotate with the cylindrical container 12, they cause the convection of the air in the heating space 34 which is heated by radiant heat from the heat source 14. This convection ensures a more efficient transfer of the radiant heat generated by the heat source 14 to both the outer surface of the cylindrical container 12 and the heat conductive members 42. Accordingly, for a heat source of a given size, the vessel drier 10 of the present invention transfers a higher percentage of the heat generated by the heat source 14 to the processing space 22 and the heat capacity of the cylindrical container 12 will be greater than that achieved with a convention vessel drier.

When the slurry L, which has been fed into the vessel drier 10 through the tubular inlet 26, touches the inner surface of the cylindrical container 12 and tumbling members 24 the liquid component of the slurry L will vaporize and a residue of ceramic material (more generally, a residue of whatever solid component is being manufactured with the vessel drier of the present invention) will form on the surfaces of the tumbling members 24. This residue will be pulverized by the collision and rubbing of the members 24 to yield a powdered ceramic material S. The powdered ceramic material S is then evacuated though the tubular outlet 18 and is collected in a container 41.

Since the cylindrical container 12 has the tapered end 16, the powdered ceramic material S is sorted in shape and size at the tapered end 16 in accordance with the rotation of the cylindrical container 12. Therefore, the shape of the powdered ceramic material S evacuated from the tubular outlet 18 has an excellent quality and has a uniform size.

As a result of the higher efficiency at which heat generated by the heater 14 is transferred to the processing space 22 of the container 12 and the larger heat capacity of the container 12, the production efficiency at which the ceramic powdered material S is manufactured is maintained even if the rate at which slurry L is added to the container 12 increases relative to the prior art vessel drier.

In the embodiment shown in FIGS. 1 and 2, the heat conductive members 42 have a flat ring shape. However, other forms of heat conductive members may be used. By way of example, and not limitation, several alternative embodiments of the heat conductive members of the present invention will be described.

Figure 3:
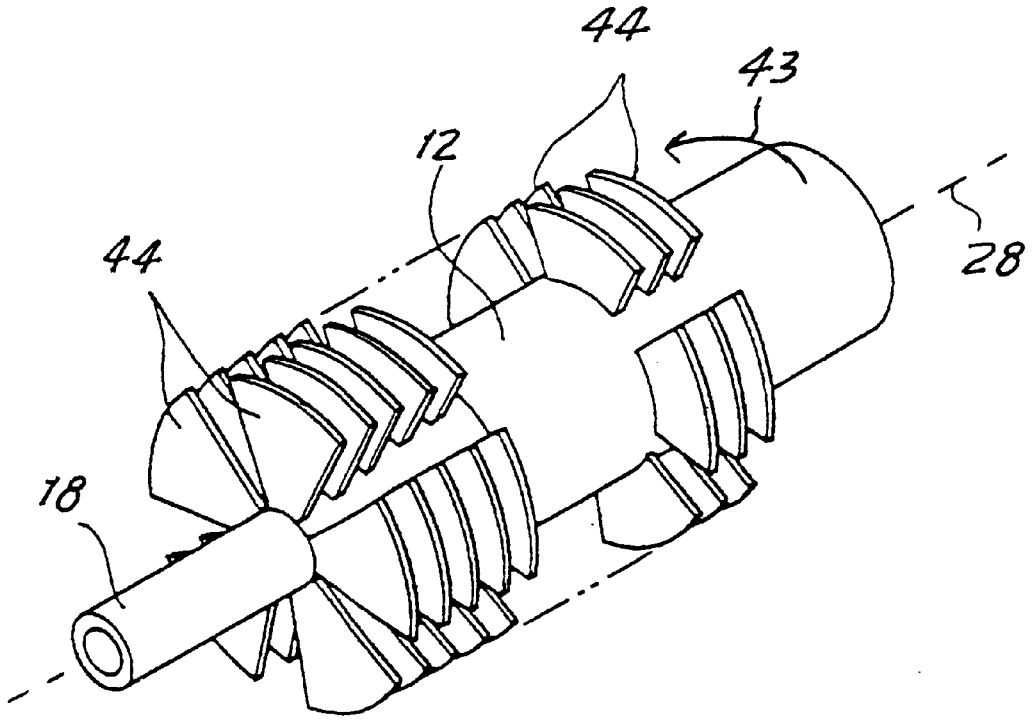
FIG. 3 shows a perspective view of a main portion of a vessel drier according to a second embodiment of the present invention.

A second preferred embodiment of the present invention is shown in FIG. 3. In this embodiment, each of the heat conductive members 44 have a fan or sector shape. Particularly, each of the heat conductive members 42 of the embodiment of FIG. 2 are replaced with a plurality of fan shaped heat conductive members 44 which are arranged in an array in the circumferential direction 43 of the cylindrical container 12. Each array lies in a respective plane which extends perpendicular to the rotational axis of the cylindrical container 12 and is spaced from the adjacent array by a predetermined distance as measured along the rotation axis 28 of the container 12. Additionally, each individual heat conductive member of a given array is aligned with a respective heat conductive member 44 of the remaining arrays so that each of the heat conductive members 44 is aligned with the respective adjacent heat conductive member 44 along the direction of the rotation axis of the cylindrical container.

Figure 4:
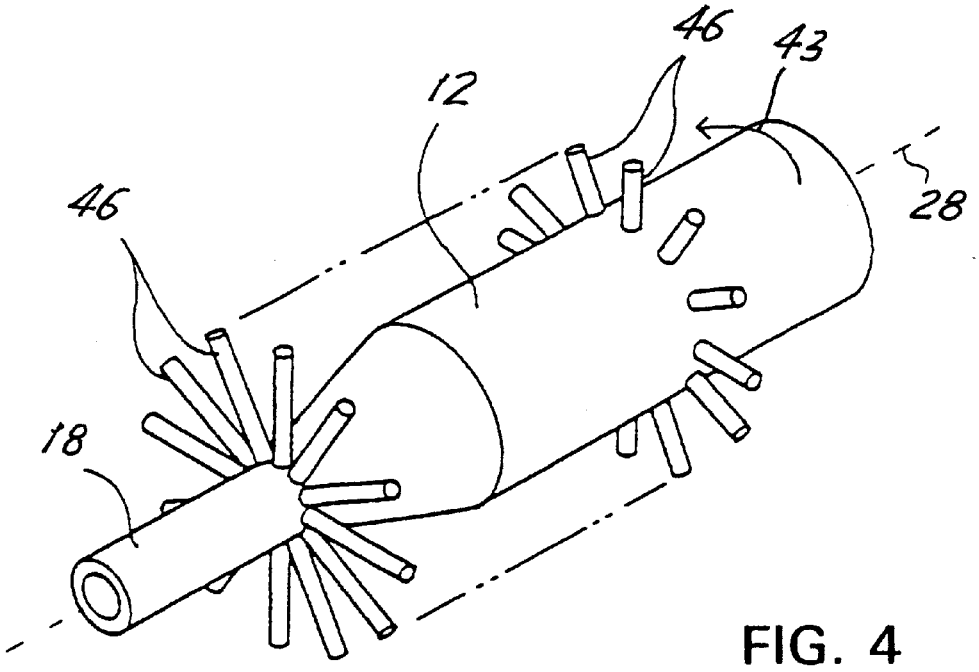
FIG. 4 shows a perspective view of a main portion of a vessel drier according to a third embodiment of the present invention.

A third embodiment of the present invention is shown in FIG. 4. In this embodiment, each of the heat conductive members 46 take the form of a stick shape. Each set of heat conductive members 46 are arranged in array extending in the circumferential direction 43 of the cylindrical container 12. Each heat conductive member 46 of a given array is aligned with a respective heat conductive member 46 of the other arrays along a direction which runs parallel to the rotation axis of the cylindrical container 12.

The structures shown in FIGS. 3 and 4 provide substantially the same effect and advantages as that provided by the flat ring shaped heat conductive members of FIGS. 1 and 2.

Figure 5:
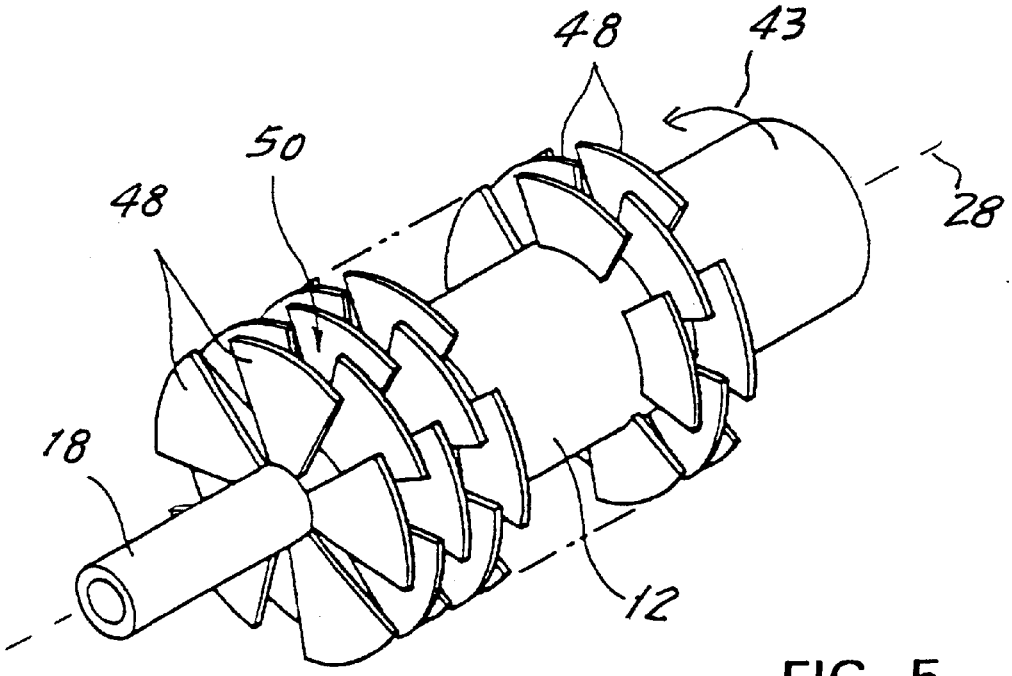
FIG. 5 shows a perspective view of a main portion of a vessel drier according to a fourth embodiment of the present invention.

A fourth embodiment of the present invention is shown in FIG. 5. In this embodiment, the heat conductive members 48 have a fan shape very similar to that of the embodiment of FIG. 3. However, in this embodiment, each of the heat conductive members in a given array of heat conductive members 48 is offset with respect to the heat conductive members 48 of the adjacent array. More particularly, each heat conductive member 48 of a given array is aligned with a respective space 50 which is located between a respective pair of heat conductive members 48 of the adjacent array.

With this structure, radiant heat passing through any of the spaces 50 will be blocked from migrating outside of the area of the heat conductive members 50 by the heat conductive member 44 aligned with that space 50. As a result, the radiant heat is maintained in the area of the heat conductive members 48 and can be effective used for heating the cylindrical container 12.

A fifth embodiment of the present invention is shown in FIG. 6. As with the embodiment of FIG. 5, the heat conductive members 52 of this embodiment also have a fan shape. However, they are not aligned in the radial or circumferential direction of the cylindrical container 12. Rather, they are provided on the outer surface of the cylindrical container 12 at an angle 54 with respect to the circumferential direction of the cylindrical container 12. More specifically, one half of the heat conductive members 52A are located towards the untapered end of the cylindrical container 12 and tilt in a direction of a counter-clockwise screw with respect to the direction of rotation 56 of the cylindrical container 12, and the other half of the heat conductive members 52B are located towards the tapered end of the cylindrical container tilt in a direction of a clockwise screw with respect to the direction of rotation 56 of the cylindrical container 12.

With the structure of this embodiment, air located between the heat conductive members 52 is carried toward the axial center of the cylindrical container 12, as shown by arrows 58 in the drawing. As a result, the heat conductive members 52 create a more effective convection of the air in the heating space 34 with the result that the enthalpy supplied to the cylindrical container 12 from the heat source 14 is further increased.

In FIG. 6, all of the heat conductive members 52 are slanted with respect to the circumferential direction of the cylindrical container 12. However, this is not absolutely required. It is sufficient if only some of the heat conductive members 52 are slanted. As long as at least one of the heat conductive members 52 is slanted with respect to the circumferential direction of the cylindrical container 12, the heat conductive member will help the convection of the air in the heating space 34 and will improve the heat efficiency of the system.

Figure 7:
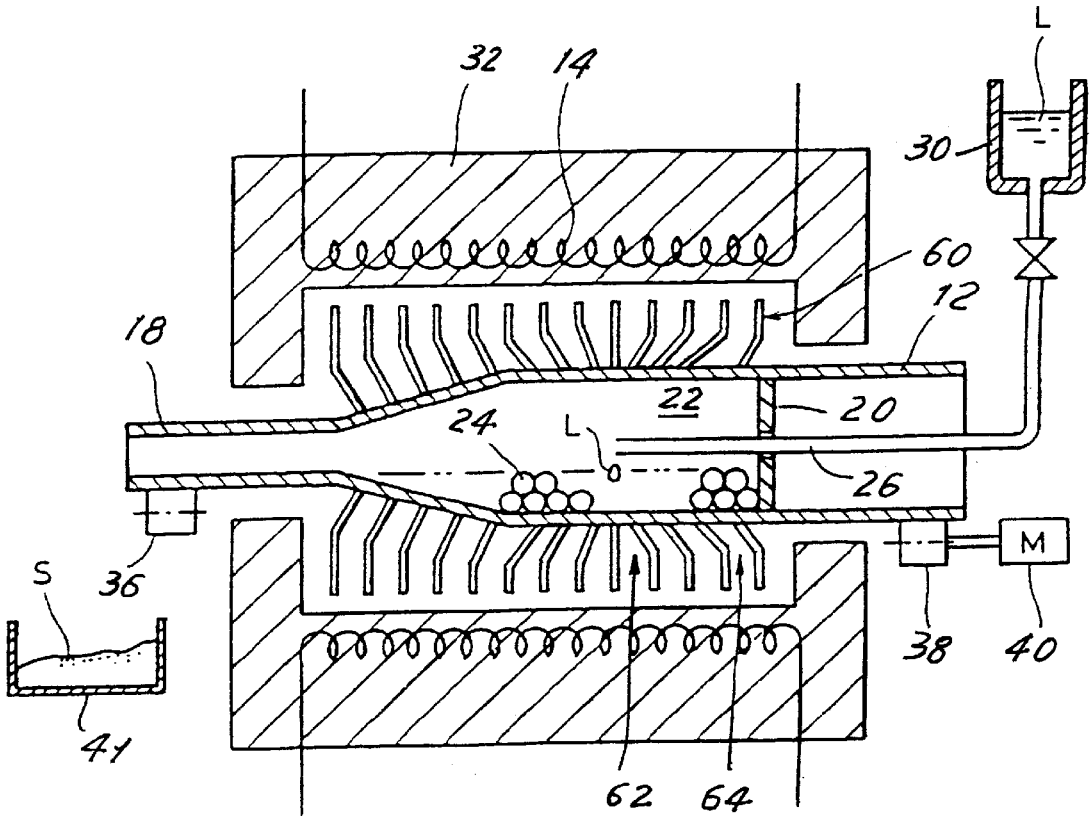
FIG. 7 shows a cross sectional view of a vessel drier according to a sixth embodiment of the present invention.

FIG. 7 shows a sixth embodiment of the present invention. In this embodiment, a plurality of heat conductive members 60 provided on the outer surface of the cylindrical container 12. However, the spacing at which the heat conductive members are connected to the outer surface of the cylindrical container 12 varies as a function of the location of the heat conductive members 60 along the axial direction of the container 12. Particularly, the spacing is narrower in the vicinity of the center of the cylindrical container 12 and wider in the vicinity of the end portions of the cylindrical containers 12. For example, spacing 62 is narrower than spacing 64.

Additionally, in this embodiment the heat conductive members 60 are bent such that the distal ends of the heat conductive members 60 are maintained at a predetermined distance from one another despite the fact that the proximal ends of the conductive members 60 are spaced by different amounts. The heat conductive members 60 may any desired shape, for example, the ring, stick or fan shapes described above. This structure is highly advantageous because it provides the greatest amount of heat to the location of the cylindrical container 12 (the center of the container in the illustrated embodiment) which receives the new slurry L and which therefore requires the greatest amount of heat. This also improves the heat efficiency of the vessel drier as compared to the prior art system.

In the embodiments described above, the heat conductive members extend from the outside of the container 12 to effectively increase the surface area of the container. However, other structure can be provided for this purpose. For example, a plurality of concave portions 68 [FIG. 8] may be provided on the outer surface of the cylindrical container 12. Since these concave portions 68 enlarge the effective area of the outer surface of the cylindrical container 12, they operate as heat conductive members and improve the efficiency with which heat will be transferred from the heater 14 to the inside of the container 12.

While not required, it is preferable that each of the concave portions be isolated from the adjacent the concave portions. Moreover, this structure may be combined with the any of the other heat conductive members shown in FIGS. 1–7 to further improve the heat transfer characteristics of the vessel drier.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A vessel drier for producing a powdered material, said vessel drier comprising:

a cylindrical container having a processing space located therein for receiving and processing a fluid raw material, said cylindrical container being rotatable along a rotation axis thereof;

a heating source, provided outside said cylindrical container, to heat said cylindrical container; and a plurality of heat conductive members for effectively providing additional surface area to said cylindrical container and thereby improving the transfer of heat from said heating source to said processing space, at least some of said heat conductive members having a fan shape with a narrow proximal end coupled to said cylindrical container and a wide distal end extending away from said cylindrical container.

2. A vessel drier according to claim 1, wherein at least some of said heat conductive members are arranged in groups, each group including a plurality of said fan shaped heat conductive members, each member of a given group lying in a single plane which is unique to that group.

3. A vessel drier according to claim 2, wherein said groups are spaced apart along said rotational axis of said cylindrical container.

4. A vessel drier according to claim 2, wherein said groups are spaced apart from one another by a first distance in the vicinity of an axially central portion of said cylindrical container and by a second distance, different than said first distance, at portions located outside of said axially central portion.

5. A vessel drier according to claim 4, wherein said second distance is greater than said first distance.

6. A vessel drier according to claim 1, wherein all of said heat conductive members have said fan shape and are arranged in groups, each group including a plurality of said heat conductive members, each member of a given group lying in a single plane which is unique to that group.

7. A vessel drier according to claim 6, wherein said groups are spaced apart along said rotational axis of said cylindrical container.

8. A vessel drier according to claim 1, wherein at least some of said heat conductive members are shaped to assist the convection of air in a space between said heating source and said container.

9. A vessel drier according to claim 8, wherein said at least some of said heat conductive members are shaped to cause air surrounding said cylindrical container to move in a direction generally parallel to said rotational axis of said cylindrical container.

10. A vessel drier according to claim 8, wherein said at least some of said heat conductive members are slanted with respect to a plane which lies perpendicular to said rotational axis of said cylindrical container.

11. A vessel drier according to claim 1, wherein all of said heat conductive members are shaped to cause air surrounding said cylindrical container to assist the convection of air in a space between said heating source and said container.

12. A vessel drier according to claim 11, wherein said heat conductive members are shaped to cause air surrounding said cylindrical container to move in a direction generally parallel to said rotational axis of said cylindrical container.

13. A vessel drier according to claim 11, wherein said heat conductive members are slanted with respect to a plane which lies perpendicular to said rotational axis of said cylindrical container.

14. A vessel drier according to claim 1, wherein said heat conductive members each have a main surface which lies in a respective plane which is oblique to said rotational axis of said cylindrical container.

15. A vessel drier according to claim 1, wherein said heat conductive members are coupled to said cylindrical container in such a manner that the greatest amount of heat is provided to said processing space at a location which receives new raw fluid to be processed.

16. A vessel drier according to claim 15, wherein said predetermined location is the center of said container.

17. A vessel drier for producing a powdered material, said vessel drier comprising:

a cylindrical container having a processing space located therein for receiving and processing a fluid raw material, said cylindrical container being rotatable along a rotation axis thereof;

a heating source, provided outside said cylindrical container, to heat said cylindrical container; and a plurality of heat conductive members for effectively providing additional surface area to said cylindrical container and thereby improving the transfer of heat from said heating source to said processing space, wherein at least some of said heat conductive members are shaped to assist the convection of air in a space between said heating source and said container.

18. A vessel drier according to claim 17, wherein said at least some of said heat conductive members are shaped to cause air surrounding said cylindrical container to move in a direction generally parallel to said rotational axis of said cylindrical container.

19. A vessel drier according to claim 17, wherein said at least some of said heat conductive members are slanted with respect to a plane which lies perpendicular to said rotational axis of said cylindrical container.

20. A vessel drier according to claim 17 wherein first and second subsets of said at least some of said heat conductive members are slanted in opposite directions to one another to cause said air surrounding said cylindrical container to move towards the axial center of said cylindrical container.

* * * * *